US007160261B1

(12) United States Patent
Huang

(10) Patent No.: US 7,160,261 B1
(45) Date of Patent: Jan. 9, 2007

(54) BACK SLIDING MASSAGER

(76) Inventor: Chih-Ming Huang, P.O. Box 166-13, Taipei (TW) 115

( * ) Notice: Subject to any disclaimer, the term of this patent is extended or adjusted under 35 U.S.C. 154(b) by 0 days.

(21) Appl. No.: 11/332,723

(22) Filed: Jan. 17, 2006

(51) Int. Cl.
*A61H 19/00* (2006.01)

(52) U.S. Cl. ..... 601/98; 601/101; 601/103

(58) Field of Classification Search ..... 601/97–99, 601/101–103, 112–113, 115–116, 122, 124, 601/126, 128
See application file for complete search history.

(56) References Cited

U.S. PATENT DOCUMENTS 4,757,808 A * 7/1988 Effler, Jr. ..... 601/148
6,402,709 B1 * 6/2002 Wu ..... 601/98
6,551,259 B1 * 4/2003 Wu ..... 601/99
6,837,861 B1 * 1/2005 Lin ..... 601/87

* cited by examiner

*Primary Examiner*—Michael A. Brown

(57) ABSTRACT

The present invention is related to a health care instrument, particularly to a back sliding massager. The massager comprising a base, a slide consists of an upper and a lower plate, a transmission mechanism, massage heads, and a cover. In that, the slide, transmission mechanism, and massage heads are mounted into the chamber constructed by the base and cover. Chains disposed on the surface of the base, transmission mechanism installed between the cover and base includes a motor, a set of gears driven by the motor having bottom pinions meshed with the chains, each of top gears connected to one massage head on top of the cover by a central axle respectively; openings formed through the cover, massage heads are exposed out from the openings. The massager of the present invention has a larger massaged portion with a man-made massage effect.

5 Claims, 2 Drawing Sheets

BACK SLIDING MASSAGER

FIELD OF THE INVENTION

The present invention is related to a medical and health care instrument, particularly to a massager can slide along the back portion of human person.

BACKGROUND OF THE INVENTION

Accompanied by the opening China society, people's living standard is to be elevated. To meet the requirements for pursuing a better life quality, massagers are in demand by some people to diminish pains; especially, back aches. In recent years, kinds of massagers are developed, such as head massager, foot massager, electromagnetic wave massager, and back massager etc. At present time, the back massager in usual is equipped with an electromagnetic hammer fixed to the back plate, which is dominated by running a programmed course to control the vibration of the electromagnetic hammer; therefore, a press, squeeze, or pinch, is exerted to the aching with fatigue body portion. Or a single vibrator is harmonized with a succession of continually pulsed vibrations to massage the body portion. However, these massagers are not only designed in a limited massaging portion, but the product expectation is also hardly met as desired. It is not expected that a conventional massager can be used to imitate and substitute for a professional massagist.

SUMMAY OF THE INVENTION

The present invention is aimed to provide a man-made effective massager applied to the back.

The present invention is practiced by a back sliding massager comprising: a base, a slide consists of an upper plate and a lower plate, a transmission mechanism, massage heads and a cover wherein the transmission mechanism and the massage heads are mounted into the chamber between the base and the cover characterized in that the chains are disposed on the surface of the base, the transmission mechanism installed between the cover and base includes a motor; a set of gears are driven by a motor having each of bottom pinions meshed with a corresponding chain respectively, and each of top gears are linked with a corresponding massage head by a central axle respectively; openings formed through the cover, said massage head extended out of the cover through the openings.

Said base has two parallel chains on the surface thereof.

Said motor has an output axle connected to a worm, the set of gears includes a first pair of dual gears disposed to the two sides of the worm, a second pair of dual gears meshed with the first pair of dual gears, a third pair of dual gears meshed with the second pair of dual gears, and a plurality of pinions of the same dimensions driven by the third pair of dual gears, pinions meshed with the two chains on the base; each of central axles disposed through a center of each corresponding gear of the first pair of gears respectively, a central axle is connected with a corresponding massage head on top of the cover respectively.

Said massage head includes a divided plank connected to a central axle and a plurality of convex blocks for massaging mounted on the divided plank, each of a plurality of springs fit between each of convex blocks and the divided plank respectively.

Said divided plank is circular shaped, three convex blocks for massaging mounted on one divided plank.

In practice, after adoption of the configuration as mentioned above, the worm is rotated by the motor, then transmitted by the transmission mechanism to drive the massage heads to rotate, the set of gears are meshed with the chains on the base, thereby the slide installed with the massage heads is driven to and fro linearly, therefore, the massage heads presses on the back to vibrate. In contrast to the conventional massager, the massager of the present invention is not only to enlarge the massaged portion, but rotate the massage head to exert pressure on the back to and fro linearly. It is kind of massager made to imitate a professional massagist.

DETEAILED DESCRIPTION OF THE PREFERRED EMBODIMENT

The description is described in detail according to the appended drawing hereinafter.

Figure 1:
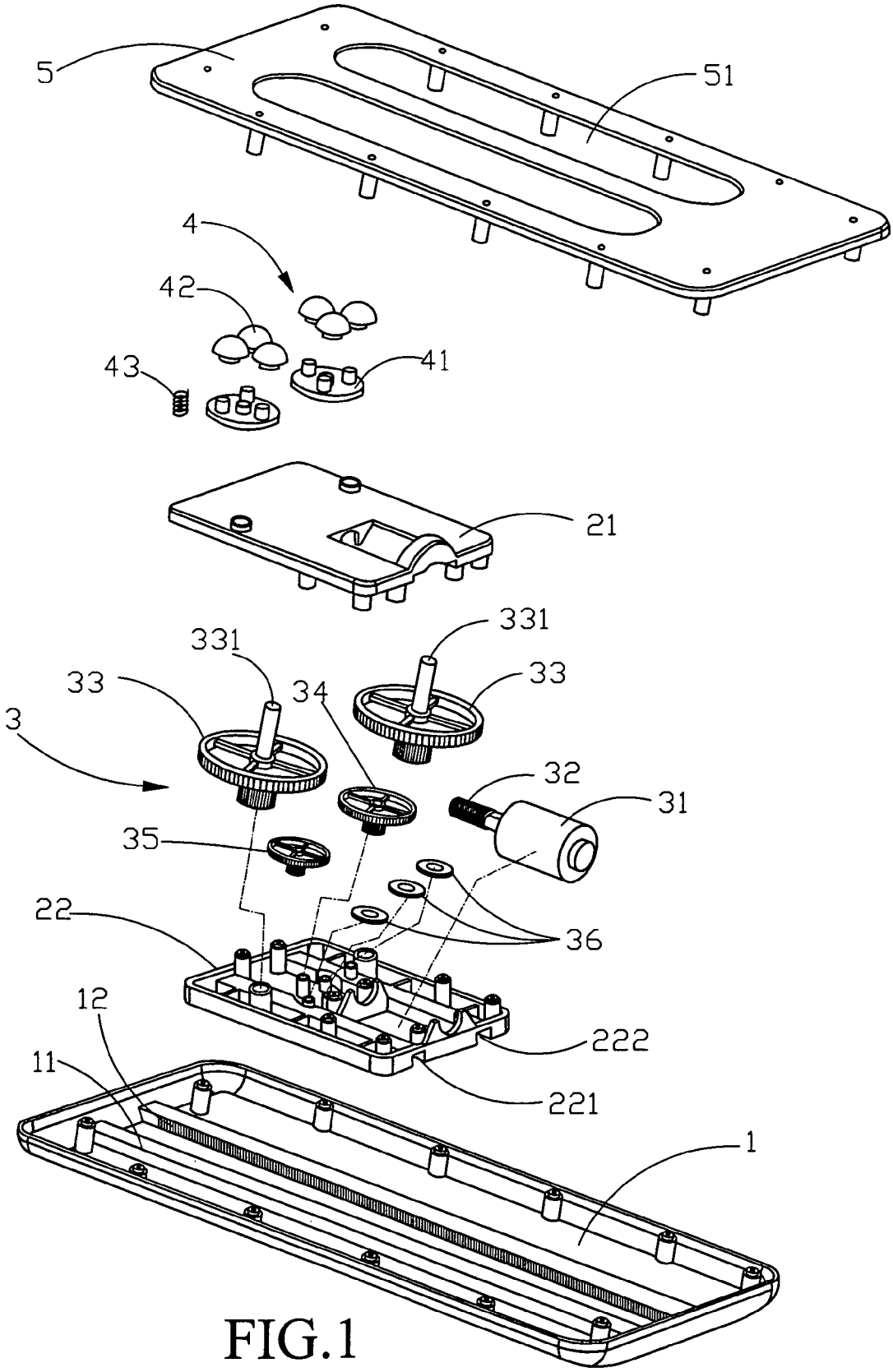
FIG. 1 is an exploded view of the massager of the present invention.
Figure 2:
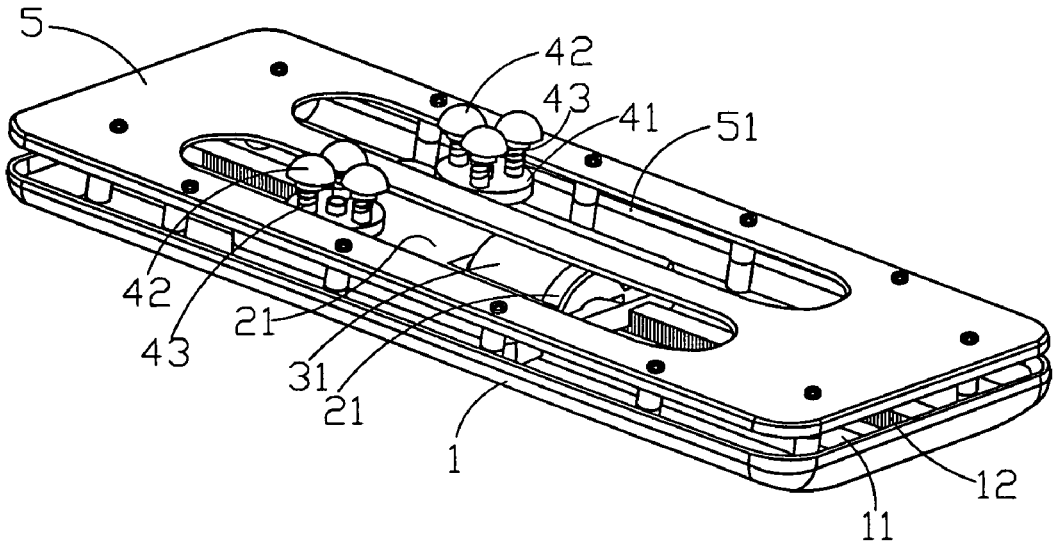
FIG. 2 is an assembly view of the massager of the present invention.

As shown in FIG. 1, the massager of the present invention includes: a base 1, a slide 2, a transmission mechanism 3, massage heads 4 and a cover 5. In which, the cover 5 is combined with the base 1 to form a hollowed chamber; the slide 2, transmission mechanism 3 and massage head 4 are mounted into the chamber. They are combined to form a massager, the assembly view of the massager is illustrated as shown in FIG. 2.

Two chains 11,12 in parallel are disposed on the surface of the base 1, the slide 2 is composed of an upper plate 21 and a lower plate 22, in which, two sliding troughs 221, 222 formed under the lower plate 22 are corresponding to the chains 11,12. Two openings 51,52 formed through the cover 5 are corresponding to the movement path of the massage heads 4; thereby two massage heads are extended out from the cover 5 through the openings 51,52.

Figure 3:
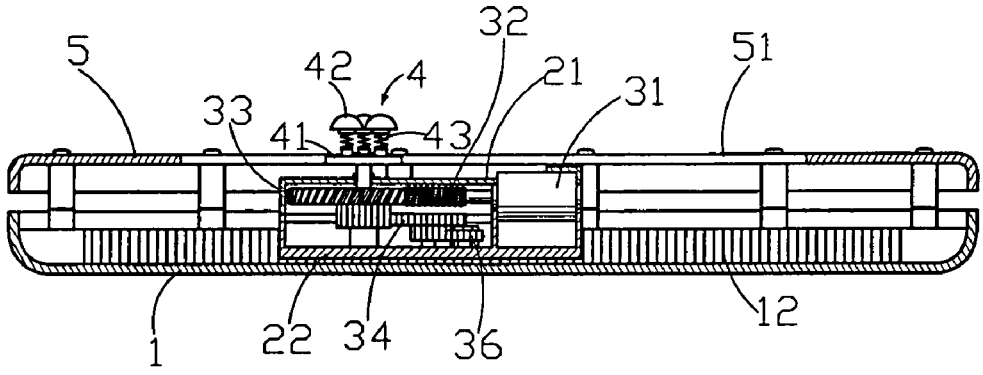
FIG. 3 is a diagrammatic side view of the massager of the present invention.

With reference to FIG. 3, a diagrammatic side view of the massager of the present invention is illustrated. Transmission mechanism 3 mounted into the slide 2, which is positioned between the upper and lower plates, The transmission mechanism includes a motor 31, a worm 32 connected to the output axle of motor, and a set of gears driven by the worm 32. In this embodiment, the set of gears includes a first pair of dual gears 33 (or top gears) disposed to the two sides of the worm 32, a second pair of dual gears 34 (or intermediate gears) are meshed with one gear of the first pair of gears, a third pair of dual gears 35 (or intermediate gears) are meshed with the other gear of the second pair of dual gears 34, and a plurality of pinions 36 (or bottom pinions) of the same dimensions are driven by the third pair of gears 35. Pinions 36 are meshed with the two chains 11,12 on the base, each of two central axles 331 is disposed through a center of one of the first pair of dual gears 33 respectively, each of the central axles 331 is connected to a corresponding massage head 4 respectively, which is mounted on the upper plate 21. Thereby, the massage heads 4 can be driven to rotate by the first pair of dual gears 33.

The massage head 4 includes a divided plank 41 with the convex blocks for massaging, which is connected to a central axle passed through a center of one of the first pair of dual gears 33 respectively. Each of the divided planks 41 is circular shaped with three convex blocks 42 for massaging mounted on the divided plank 41. Each of the convex blocks 42 mounted on the massage head having a spring 43 fit between the convex block 42 and the divided plank 41. Therefore, the massage force exerted to the body portion can be adjusted by the spring 43, and manages to imitate the massagist made a healing massage or therapy massage to the back portion of human person.

When the massage "therapy", or massage type of work is performed through the massage heads 4. The worm 32 is driven to rotate by the motor 31; in turn, the worm 32 is to drive the larger gear of the first pair of dual gears 33 to rotate the first pair of gears 33. The first pair of gears 33 further drives the massage heads 4 to rotate by the central axles 331 to perform the massage "therapy". At the same time, a larger gear of the second pair of dual gears 34 is meshed with the smaller gear of the first pair of gears 33, the second pair of gears 34 are driven to rotate by the first pair of gears 33, under the same condition, the third pair of gears 35 are driven by the second pair of gears 34. Three pairs of dual gears 33,34,35 including one pair of top gears 33 and two pairs of intermediate gears 34,35 are adopted to facilitate the rhythmic sliding speed of the slide 2 along the chains 11,12 totally in control. Even the bottom pinions 36 of the same dimensions can be used to facilitate the same tempo of the sliding speed while sliding to and fro along both of the chains 11,12.

Therefore, in contrast with the conventional massagers, the massager of the present invention not only has a larger massage portion, but also has a better effect.

The preferred embodiment of the present invention is described above, which is not restricted to the scope and spirit of the present invention, the modifications to the present invention, which is known to the persons skilled in the art, according to the principles and characteristics of the present invention, should be contained in the scope and spirit of the claims as following.

What is claimed is:

1. A back sliding massager comprising: a base (1), a slide consists of an upper plate (21) and a lower plate (22), a transmission mechanism (3), massage heads (4) and a cover (5) wherein the transmission mechanism (3) and the massage heads (4) are mounted into a chamber between the base (1) and the cover (5) characterized in that chains (11,12) are disposed on the surface of the base (1), the transmission mechanism (3) installed between the cover (5) and the base (1) includes a motor (31); a set of gears, are driven by the motor (31), having bottom pinions (36) meshed with the chains (11,12), and each of top gears (33) is connected to a massage head (4) by a central axle (331) respectively; openings (51,52) formed through the cover (5), said massage head (4) extended out of the cover (5) through the openings (51,52).

2. A back sliding massager according to claim 1 wherein the base (1) has two chains (11,12) in parallel on the surface thereof.

3. A back sliding massager according to claim 1 wherein the motor (31) has an output axle connected to a worm (32), the set of gears includes a first pair of dual gears (33) disposed to the two sides of the worm (32), a second pair of dual gears (34) meshed with the first pair of dual gears (33) a third pair of dual gears (35) meshed with the second pair of dual gears (34), and the plurality of pinions (36), the same pinions recited in claim 1, of the same dimensions driven by the third pair of dual gears (35), the pinions (36) meshed with the two chains (11,12) on the base; each of central axles (331) disposed through a center of each corresponding gear of the first pair of gears (33) respectively, said central axle (331) is connected with a massage head (4) on top of the cover (5) respectively.

4. A back sliding massager according to claim 1 wherein the massage head (4) includes a divided plank (41) connected to said central axle (331) and a plurality of convex blocks (42) for massaging mounted on the divided plank (41), each of a plurality of springs (43) fit between one convex block (42) and said divided plank (41) respectively.

5. A back sliding massager according to claim 1 wherein the divided plank (41) is circular shaped, three convex blocks (42) for massaging mounted on said divided plank (41).

* * * * *